United States Patent [19]

Goode

[11] 4,010,961

[45] Mar. 8, 1977

[54] SKI TIE

[76] Inventor: David Paul Goode, 2015 Long Lk. Shores, Orchard Lake, Mich. 48033

[22] Filed: May 17, 1976

[21] Appl. No.: 687,170

[52] U.S. Cl. ..... 280/11.37 A; 24/16 PB; 24/81 CC; 24/81 SK; 224/45 S

[51] Int. Cl.[2] ..... A63C 11/02

[58] Field of Search ..... 280/11.37 A, 11.37 K; 224/52, 45 S; 24/81 SK, 81 CC, 16 PB; 211/60 SK; 132/48 R, 48 A

[56] References Cited

UNITED STATES PATENTS

| | | | |
|---|---|---|---|
| 2,469,604 | 5/1949 | Lynn | 211/60 SK |
| 3,830,416 | 8/1974 | Smedley | 224/45 S |
| 3,841,648 | 10/1974 | Meyer | 280/11.37 A |
| 3,893,606 | 7/1975 | Hofmann | 280/11.37 K |

FOREIGN PATENTS OR APPLICATIONS

| | | | |
|---|---|---|---|
| 58,027 | 5/1937 | Norway | 280/11.37 A |
| 41,353 | 5/1925 | Norway | 280/11.37 A |
| 27,169 | 3/1899 | United Kingdom | 24/16 PB |

*Primary Examiner*—Joseph F. Peters, Jr.
*Assistant Examiner*—David M. Mitchell
*Attorney, Agent, or Firm*—Thomas N. Young

[57] ABSTRACT

A ski tie comprising a four-inch polyethylene rod having moderately enlarged heads heat formed at the opposite end thereof and a stretchable rubber strip having one end of the rod extending centrally therethrough such that the opposite portions thereof are stretchable in opposite directions over each of a pair of skis disposed in bottom-to-bottom relationship. The ends of the strip have apertures formed therein to permit them to be hooked around the other end of the rod.

8 Claims, 3 Drawing Figures

Fig-1
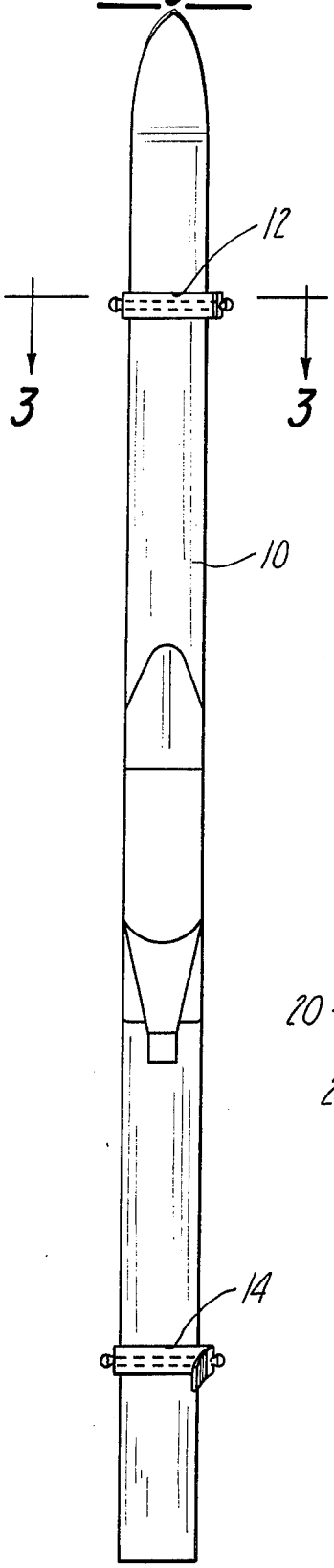
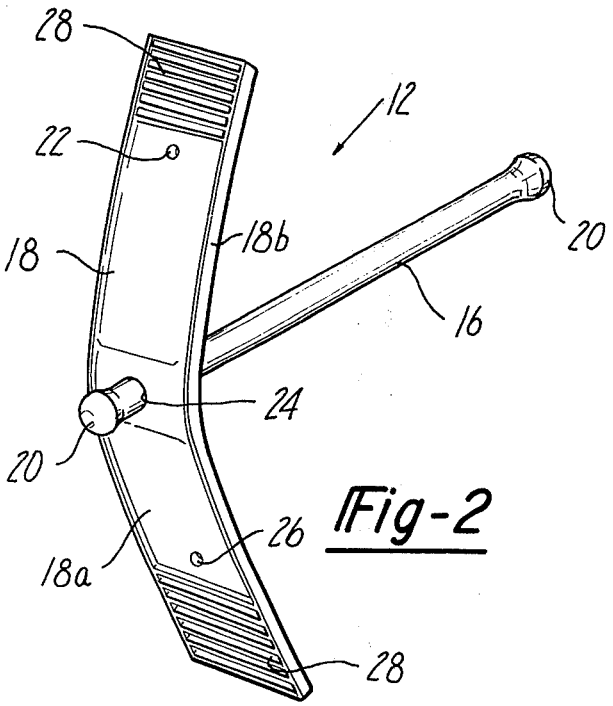
Fig-2
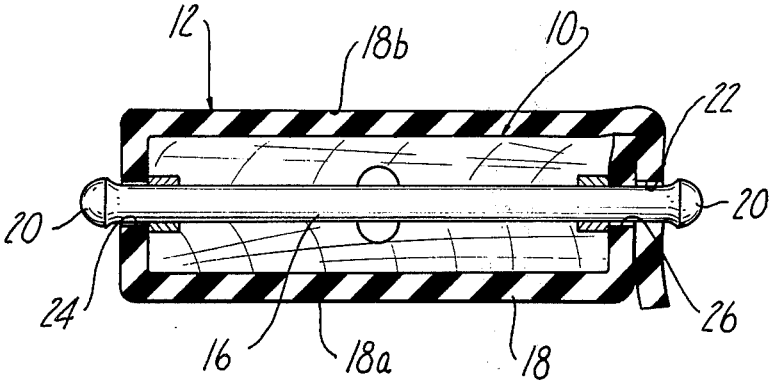
Fig-3

SKI TIE

INTRODUCTION

This invention relates to devices for binding a pair of skis together in bottom-to-bottom relationship for storage and transportation thereof. Such devices are commonly called ski ties and are used in sets of two or more to secure skis firmly together.

BACKGROUND OF THE INVENTION AND PRIOR ART

It is customary when transporting or storage skis to bind them securely together in bottom-to-bottom relationship so as to protect the edges and soft bottom surfaces of the skis from accidental damage. According to the prior art, this can be accomplished in various ways. By far the most popular way has been simply to secure a strap of leather or fabric around the skis, either with or without a spacer between the skis, the strap typically having a buckle or other clasp which permits the strap to be adjustably secured around the skis at or near the tips and tails thereof. An alternative ski tie comprises a pre-formed plastic clip having flexible peripheral edges into which the skis are snapped.

Still another approach to securing skis together is described in the United States Pat. No. 2,469,604 to Lynn. In that patent a ski retaining device is described comprising a block of resilient material such as rubber having a long flat metal pin imbedded therein with an enlarged head protruding from one edge of the block. In addition, a strap of flexible material such as rubber is secured to an opposite edge of the block with portions projecting in opposite directions, each portion being stretchable over one ski in a pair of skis disposed in bottom-to-bottom relationship. The ends of the flexible strap are provided with holes whereby they may be forced over the enlarged head of the pin, one at a time, to provide a secure assembly in which the two skis are bound together, the bottoms being held apart by the spacer block.

BRIEF DESCRIPTION OF THE INVENTION

A principal objective of the present invention is to provide a ski tie generally of the type described in the Lynn patent but substantially improved thereover for ease and economy of manufacture, as well as simplicity of design and use.

In general, the device of the present invention comprises an elongate spacer rod of relatively soft polymeric material, such as polyethylene, having moderately enlarged integral heads formed on the opposite ends thereof, the length of said rods between said heads being about the width of a ski such that the rod may be placed between the bottoms of a pair of skis with the heads extending beyond the lateral extremities of the skis. The device further comprises a strip of elastically elongatable material such as rubber disposed on the rod adjacent one of the heads and having portions on opposite sides of the rod which may be stretched over the tops of respective skis in the bottom-to-bottom pair and hooked, by means of apertures, around the opposite head, one at a time, to form a secure combination wherein the skis are firmly held with the bottoms spaced apart.

In general, the method of manufacturing the subject ski tie comprises the steps of separating a length of solid polymeric rod into segments of approximately four inches, forming moderately enlarged integral heads on the ends of said segments and placing a precut strip of flexible material such as rubber over one of the heads. The method preferably involves heating the ends of the rods to form the heads by natural heat-induced contraction of the polymeric material.

The invention thus eliminates the separate block and pin of the Lynn patent as well as the method of assembly thereof. In addition, the strip is more readily fastened to the assembly.

The invention may be best understood by reading the following specification which sets forth an illustrative, specific and preferred embodiment of the invention in such full, clear and concise detail as to enable those skilled in the art to manufacture and use the same.

BRIEF DESCRIPTION OF THE DRAWINGS

FIG. 1 is a plan view of a pair of snow skis having two of the illustrative devices disposed thereon to secure the skis together in bottom-to-bottom relationship;

FIG. 2 is a perspective view of a ski tie embodying and made in accordance with the invention; and FIG. 3 is a sectional view through the assembly of FIG. 1 showing the internal construction of the ski tie when arranged on and in connection with a pair of snow skis in bottom-to-bottom relationship.

DETAILED DESCRIPTION OF THE SPECIFIC EMBODIMENT

Referring to FIG. 1, a pair of snow skis 10 are bound together in bottom-to-bottom relationship; i.e., with the bottoms of the skis facing and in close proximity to one another, by means of ski ties 12 and 14 which are wrapped around the skis near the tips and tails, respectively. Each of the ski ties 12 and 14 comprises a spacer rod of relatively soft polymeric material disposed between the ski bottoms and flexible rubber strip extending around the skis as hereinafter described in greater detail.

FIG. 2 shows ski tie 12 to comprise only two distinct components: a spacer rod 16 of relatively soft, pliable, solid, polyethylene, and a strip 18 of elastically elongatable material such as rubber disposed on the rod 16 adjacent one of the ends thereof. Rod 16 is approximately 4 inches in length, the actual length varying over a wide range to accommodate everything from the relatively narrow cross-country skis to the relatively broad jumping skis and, at the extreme, the much wider skis used for water skiing. Heads 20 of moderately enlarged diameter are formed at the opposite ends of rod 16, the width of the rod 16 between the heads being such that the heads project laterally beyond the edges of the skis when in the bound form illustrated in FIGS. 1 and 3.

The strip 18 is approximately 4 to 5 inches in relaxed length, approximately three-fourths of an inch in width, three-sixteenths of an inch in thickness and is provided with three apertures 22, 24, and 26 spaced along the length thereof. Aperture 24 is formed centrally of the strip such that one end of the rod 16 may be thrust therethrough to mount the strip on the rod. Apertures 22 and 26 are spaced closer to the ends of the strip for purposes to be described. Gripping surfaces 28 may be formed in the opposite ends to facilitate grasping the strip under cold, wet, or snowy conditions for installation purposes.

FIG. 3 is a sectional view through the assembled combination of skis 10 and ski tie 12 of FIG. 1. To utilize the ski tie 12 to bind the skis 10, the skis are first placed in bottom-to-bottom relationship with the rod 16 disposed as a spacer therebetween. The enlarged heads 20 of rod 16 project laterally beyond the extremities of the skis. Strip 18 is mounted centrally on the left end of rod 16 as shown in FIG. 3 with half portions on opposite sides of the rod. The bottom half portion 18*a* of strip 18 is stretched over the bottom ski in the pair 10 and the aperture 26 is thrust over and past the opposite head on rod 16. Thereafter the upper half portion 18*b* of strip 18 is stretched over the top ski in pair 10 and the right hand head 20 of rod 16 is caused to pass through the aperture 22 thus hooking the two stretched end portions of the strip in place. The result is a securely bound, spaced apart pair of skis 10 neatly wrapped for transportation either with or without an enclosing ski bag.

The manufacture of the ski tie 12 is preferably carried out by acquiring substantial lengths of solid quarter-inch polyethylene stock having a density of approximately 0.92 and a good pliability over a broad temperature range, especially in the low temperature ranges of of 0° to 32° F. The lengths of solid polyethylene rod are then cut into segments of approximately four inches each, the actual length of the segments varying in accordance with the type of skis with which the ties are to be used. The ends of the segments are then heated, such as over an open gas flame, until the polymeric material softens and beads up by natural contraction to form the moderately enlarged heads 20. The strips 18 are preferably molded rubber and the apertures 22, 24, and 26 are punched therein. One end of the rod 16 is thereafter thrust through the central aperture 24 and the ties are packaged for sale in groups of two or four.

While the invention has been described with reference to a specific embodiment, it is to be understood that various modifications and additions to the invention are possible and will occur to those skilled in the art. Accordingly, the foregoing description is not to be construed in a limiting sense.

The embodiments of the invention in which an exclusive property or privilege is claimed are defined as follows:

1. A device for binding a pair of skis together in spaced bottom-to-bottom relationship comprising: an elongate spacer rod of relatively pliable polymeric material having moderately enlarged integral heads on the opposite ends thereof, the length of said rod between said heads being about the width of a ski whereby the rod may be placed between a pair of skis with the heads extending beyond the lateral extremities thereof; and a strip of elastically elongatable material including a first aperture located approximately at its center, said strip in the configuration binding said skis being disposed on the rod adjacent one of the heads with said first aperture encircling said rod and having portions extending in opposite directions from said first aperture; second and third apertures in the strip near respective opposite ends thereof with one strip portion stretched over one ski in said pair and hooked over the opposite head via the second aperture and the other strip portion stretched over the other ski in said pair and hooked over said opposite head via the third aperture.

2. A device as described in claim 1 wherein the opposite portions of said strip have gripping ridges formed therein.

3. A device as described in claim 1 wherein the rod is formed of solid polyethylene stock.

4. A device as described in claim 1 wherein the rod is approximately four inches in length.

5. A device as described in claim 4 wherein the strip is approximately four to five inches in length when in the relaxed condition.

6. A method of making a ski tie for binding skis in spaced bottom-to-bottom relationship consisting of the steps of:

a. separating a length of solid polymeric rod into segments of approximately four inches;
b. forming moderately enlarged integral heads on the ends of said segments; and
c. placing a strip of flexible material over one of the heads.

7. The method defined in claim 6 wherein the step of forming the heads is accomplished by heating the ends of the segments.

8. The method defined in claim 6 wherein the step of placing the strip on the segment consists of the substeps of forming three spaced apertures in a strip of flexible material and thrusting the head of the segment through the central one of said apertures.

* * * * *